US007374173B2

(12) United States Patent
Nasuti

(10) Patent No.: US 7,374,173 B2
(45) Date of Patent: May 20, 2008

(54) TARGET APPARATUS

(76) Inventor: Randy Nasuti, 18989 Holbrook, Eastpointe, MI (US) 48021

( * ) Notice: Subject to any disclaimer, the term of this patent is extended or adjusted under 35 U.S.C. 154(b) by 299 days.

(21) Appl. No.: 10/907,666

(22) Filed: Apr. 11, 2005

(65) Prior Publication Data

US 2005/0230918 A1 Oct. 20, 2005

Related U.S. Application Data

(60) Provisional application No. 60/563,693, filed on Apr. 20, 2004.

(51) Int. Cl.
*F41J 1/10* (2006.01)
*F41J 7/00* (2006.01)

(52) U.S. Cl. ..... 273/407; 273/403; 273/406

(58) Field of Classification Search ..... 273/403–410, 273/390–392

See application file for complete search history.

(56) References Cited

U.S. PATENT DOCUMENTS 398,186 A * 2/1889 Rehfus ..... 273/406
863,486 A * 8/1907 Aiken ..... 273/406
1,981,293 A * 11/1934 Varrelman ..... 273/404
2,034,839 A * 3/1936 Sheffield ..... 273/382
2,048,155 A * 7/1936 Armantrout ..... 273/407
3,519,272 A * 7/1970 Vogelaere ..... 273/404
3,601,353 A * 8/1971 Dale ..... 248/470
4,247,116 A * 1/1981 McQuary ..... 273/394
4,583,744 A * 4/1986 Tolliver et al. ..... 273/404
5,169,157 A * 12/1992 Salmon ..... 273/407
5,829,753 A * 11/1998 Wiser ..... 273/407
6,257,584 B1 * 7/2001 Nasuti ..... 273/407
6,435,512 B1 * 8/2002 Beckwith, Sr. ..... 273/407
6,543,778 B2 * 4/2003 Baker ..... 273/407

* cited by examiner

*Primary Examiner*—Mark S Graham
(74) *Attorney, Agent, or Firm*—Harness, Dickey & Pierce, P.L.C.

(57) ABSTRACT

A target apparatus includes a first rod having a first end and a second rod having a second end. The target apparatus further includes a tubular target receiver non-rotatably coupled to the first rod and the second rod. The first end and the second end are received within the tubular target receiver. A tubular target dispenser is coupled to the first rod and the second rod. A target is sized to be coupled between the tubular target receiver and the tubular target dispenser.

1 Claim, 3 Drawing Sheets

TARGET APPARATUS

RELATED APPLICATIONS

The present invention claims priority to provisional application 60/563,693 filed Apr. 20, 2004, the disclosure of which is incorporated by reference herein.

TECHNICAL FIELD

The present invention relates generally to shooting targets. More specifically, the present invention relates to a portable target for assisting a gun user in determining the direction and spread of a shot.

BACKGROUND OF THE INVENTION

For fire arm users, it is important to properly adjust the sight to coincide with the direction of a shot. Various types of ammunition by various manufacturers may have different firing characteristics. A hunter commonly tests his firing arm to insure alignment with the sight.

Testing alignment is particularly important when using a shotgun. The pattern that the shot from a shotgun makes is very important. The shot pattern can vary widely between various types and brands. It is, therefore, necessary to properly calibrate a shotgun for accurate shooting.

When hunting, patterning of a shotgun is commonly carried out in the woods. A piece of paper is propped up against a tree or other supporting structure while the hunter takes a practice shot. Several drawbacks to such an approach should be evident to hunters. First, it is often difficult to secure a piece of paper with implements found in the woods. The large size paper needed and the means to hold it is often cumbersome and hard to come by. Second, it is common that the target is located at or very near the ground. This does not provide an accurate angle for patterning.

Known targets such as those described in U.S. Pat. Nos. 2,048,155 and 4,811,956 each offer a target holding solution. Each of the target mechanisms are very complex and are believed to be expensive to manufacture. Also, the weight associated with the complex mechanisms is believed to make these target holders not suitable for traveling in a pack for a day in the woods.

SUMMARY OF THE INVENTION

It is, therefore, one object of the invention to provide an easily transportable target apparatus. It is a further object of the invention to provide a lightweight and collapsible target apparatus.

In one aspect of the invention, a target apparatus includes a first rod having a first end and a second rod having a second end. The target apparatus further includes a tubular target receiver non-rotatably coupled to the first rod and the second rod. The first end and the second end are received within the tubular target receiver. A tubular target dispenser is coupled to the first rod and the second rod. A target is sized to be coupled between the tubular target receiver and the tubular target dispenser.

In a further aspect of the invention, the first and second portion of the first rod and the first and second portion of the receiver rod each have a length shorter than the first rod. In transport, the first and second portions of the first rod and the first and second portions of the receiver rod fit within the tubular target dispenser.

One advantage of the invention is that the target apparatus may be formed from lightweight materials such as fiberglass or thin steel rods. Another object of the invention is that due to its compact size and self-storing capability, the target apparatus may be easily transported for a day in the woods or at target range.

Other objects and features of the present invention will become apparent when viewed in light of the detailed description of the preferred embodiment when taken in conjunction with the attached drawings and appended claims.

BRIEF DESCRIPTION OF THE PREFERRED EMBODIMENT

Figure 1:
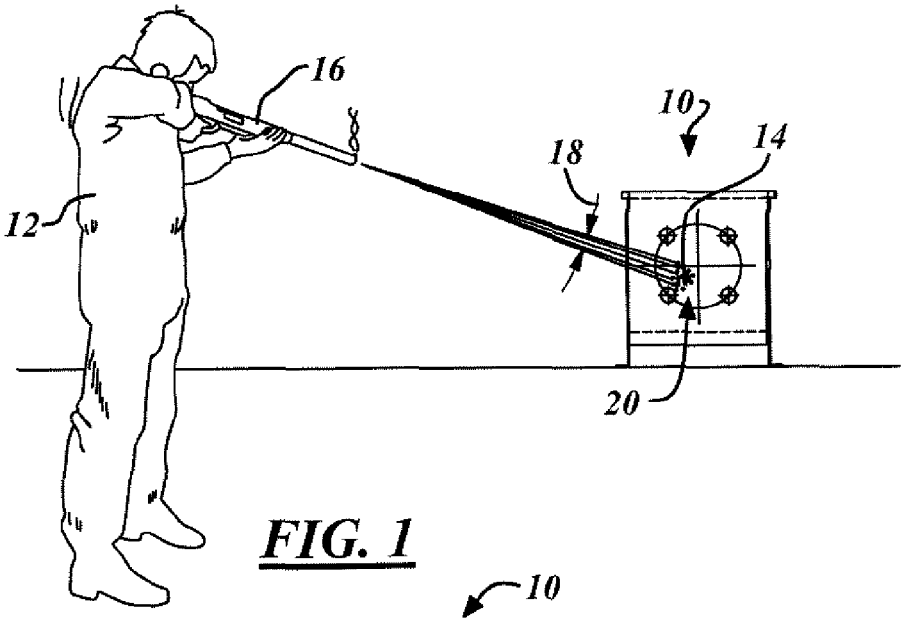
FIG. 1 is a perspective view of a shooting target apparatus with respect to a gun user.

Referring now to the drawings, like reference numerals are used to identify identical components in the various views. While a preferred embodiment is illustrated with respect to a shotgun, the teachings may apply equally to other firearms such as handguns and rifles, and may also be used with archery or other shooting devices.

Referring now to FIG. 1, a target apparatus 10 is shown with respect to a hunter 12 who is firing shot 14 from a shotgun 16. As is shown, shot 14 has a diverging angle 18. By using target apparatus 10, a pattern 20 formed by shot 14 may be measured. Target apparatus 10 may be positioned at various distances from hunter 12. Also, the type of shot and barrel constriction of shotgun 16 may also be varied so that a variety of conditions may be simulated.

Figure 2:
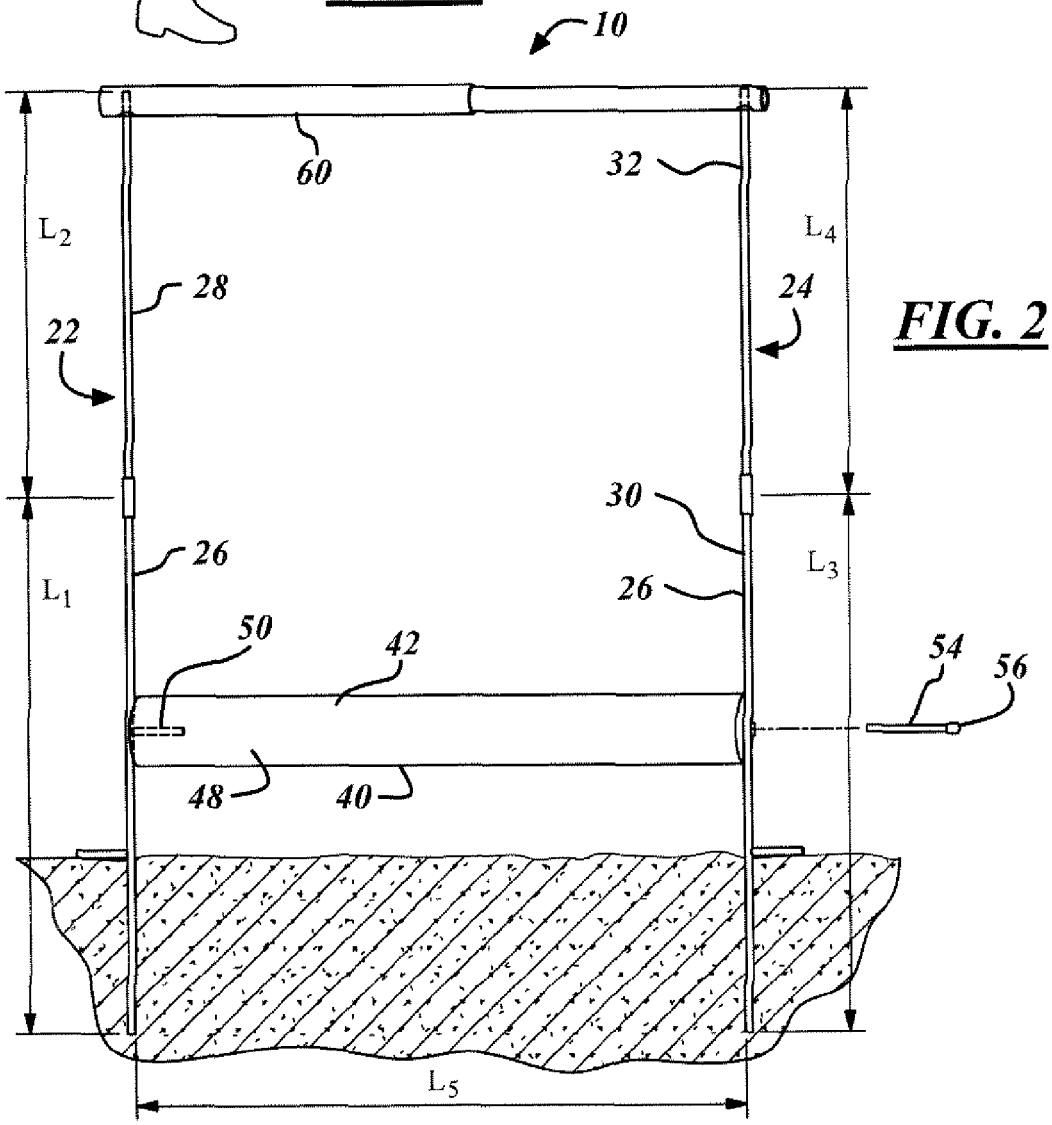
FIG. 2 is a front view of a target apparatus according to the present invention.
Figure 3:
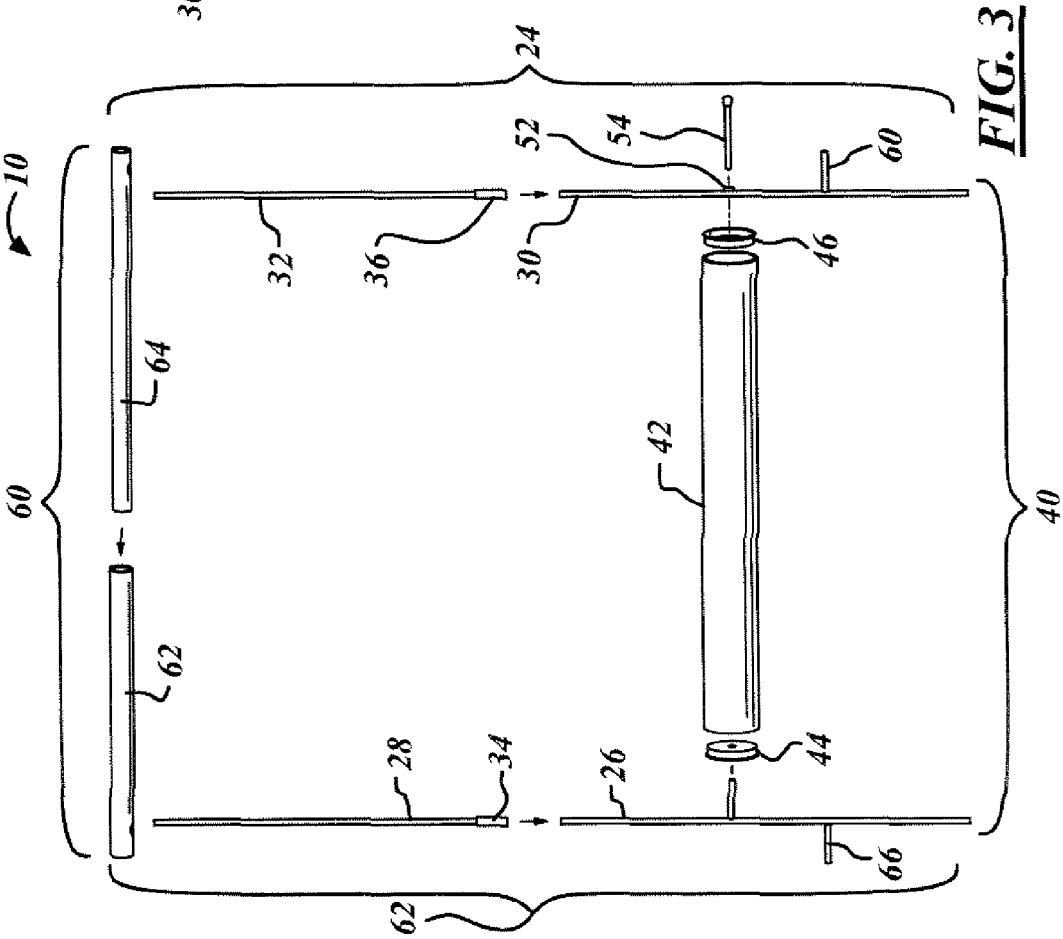
FIG. 3 is an exploded view of the target apparatus according to the present invention.

Referring now to FIGS. 2 and 3, a target apparatus 10 is shown having a first rod 22 and a second rod 24 that are substantially vertical with respect to the ground. First rod 22 has a first portion 26 which is connected to a second portion 28. Second rod 24 has a first portion 30 and a second portion 32. First portion 30 is connected to second portion 32. In the preferred embodiment, first portions 26, 30 are respectively coupled to second portions 28, 32 by ferrules 34, 36.

Figure 7:
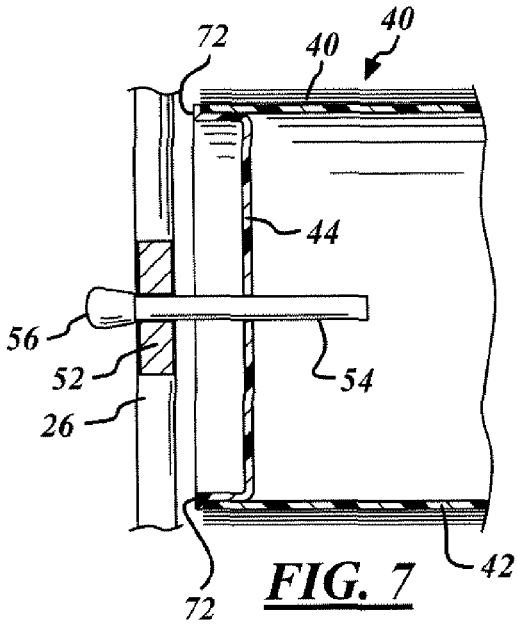
FIG. 7 is a cross-sectional view of a target apparatus coupled to the pin 54.

A tubular target dispenser assembly 40 is positioned between the first rod 22 and the second rod 24. Preferably, the tubular target dispenser assembly 40 is rotatably coupled to the first rod 22 and the second rod 24. The tubular target dispenser assembly has a target dispenser 42, a first end cap 44, and a second end cap 46. When assembled, the first end cap 44 and the second end cap 46 are received at least partially within the target dispenser 42. An interference fit may secure the first end cap 44 and the second end cap 46 within the target dispenser 42. The tubular target dispenser assembly 40 may also include targets 48. The targets 48 may be positioned on the outside of the target dispenser 42. This is best shown in FIG. 7 below. As will be further described below, the end caps 44, 46 may include openings so that the target dispenser 42 is rotatably coupled to the first rod 22 and the second rod 24.

The first portion 26 of the first rod 22 may include a fixed pin 50 that is to be received within the opening of the first end cap 44. The fixed pin 50 may be made of the same material as the rods and may be integrally formed therewith or otherwise fixably attached thereto. For example, the fixed pin 50 may be welded to the first portion 26 of the first rod 22.

The first portion 30 of the second rod 24 may include a pin receiver 52. The pin receiver 52 may also be formed of the same material as the rods and integrally formed therewith. The pin receiver 52 may also be formed separately and affixed thereto by welding or other processes. The pin receiver 52 has an opening that is sized to receive pin 54. Pin 54 is sized to extend through the pin receiver 52 and into the target dispenser 42. The pin receiver 52 supports the second end cap 46. The pin 54 may include a cap 56 that may, for example, be a rubber tipped cap. The cap 56 prevents the pin 54 from slipping through the opening in the pin receiver 52.

A target receiver 60 is coupled to a first end of the first rod 22 and a second end of the second rod 24. The first end and second end are opposite the ground. That is, the ends of the second portion 28 of the first rod and the second portion 32 of the second rod may be received within an extendable target receiver 60. The target receiver 60 may include a first portion 62 having an exterior diameter and a second portion 64 having an interior diameter sized to slidably receive the first portion therein. As is illustrated, the ends of the first and second rods extend into the interior of the target receiver 60 without going through. The target receiver 60 helps support the rods in a predetermined position. The target receiver 60 is positioned so that the target may extend thereto. The target receiver 60 may have a target coupled around or directly to the target to it. Preferably, the target is non-rotatably coupled to the ends of the first rod and second rod.

A first portion 26 of the first rod 22 and the first portion 30 of the second rod 24 may include foot pegs 66. Foot pegs 66 allow the rods to be easily pushed into the ground as is best illustrated in FIG. 2.

The first portion 26 has a length $L_1$ and second portion 28 has a second length $L_2$. The first portion 30 has a length $L_3$ and the second portion has a fourth length$_4$. The target dispenser 42 has a fifth length $L_5$, which is longer than the lengths $L_1$, $L_2$, $L_3$, and $L_4$ so that the portions of the first rod and the portions of the second rod may be received within the hollow interior of the target dispenser 42.

Target 48 may be formed of paper. A number of targets may be contained in a single roll, perforations may be provided through the target so that individual targets may easily be separated. The targets may include a removable adhesive such as the adhesive used on Post-it® brand notes manufactured by the 3M Company. Such adhesive allows the target to be easily attached to the target receiver 60 and to the target dispenser 42. The adhesive is preferably applied to one or two edges of the target so that a sufficient amount of holding force may be applied. The adhesive also secures the targets to the target dispenser 42 during transportation. Various aiming indicia may be included such as ring targets as is best illustrated by the rings in FIG. 1. The targets may also be separate targets individually rolled around the target dispenser 42 on top of each other.

Figure 4B:
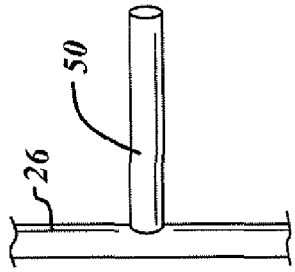
FIG. 4B is a side view of the fixed pin according to the present invention.
Figure 4A:
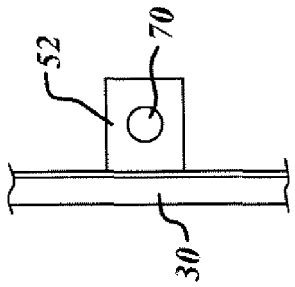
FIG. 4A is a side view of a pin receiver of the present invention.

Referring now to FIG. 4A, an enlarged view of the first portion of the second rod 30 is illustrated with the pin receiver 52. The pin receiver 52 includes an opening 70 sized to receive the pin 54 therein.

Referring now to FIG. 4B, the first portion of the first rod 22 is illustrated with fixed pin 50 thereon. The fixed pin 50 is sized to be received within an opening in the end caps.

Figure 5:
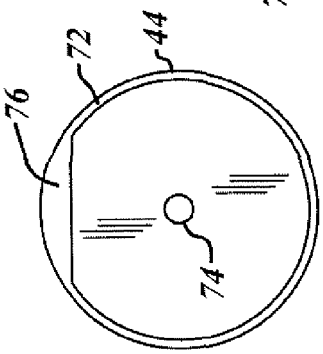
FIG. 5 is an end view of an end cap according to the present invention.

Referring now to FIG. 5, a side view of the first end cap 44 is illustrated. End cap 44 may include a flange 72 that is larger than the interior diameter of the tube forming the target dispenser 42. This prevents the end cap from sliding into the target dispenser 42. The end cap 44 may include an opening 74. The opening 74 is sized to receive the pin 54 or the fixed pin 50. Preferably, each end cap 44, 46 is formed in a similar manner to FIG. 5. Each end cap may also include a handle or grip 76 to facilitate the removal and insertion of a cap within the target dispenser 42.

Figure 6:
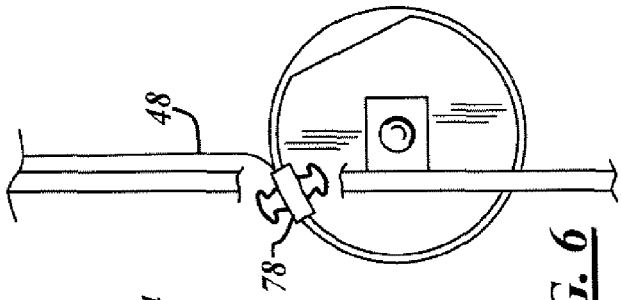
FIG. 6 is a side view of the target apparatus having a wind clip 78.

Referring now to FIG. 6, a wind clip 78 may be used on each side of the target apparatus, only one side of which is illustrated. The wind clip 78 may be used to secure the target to the target dispenser 42. The wind clip 78 may, for example, be a spring clip such as a binder clip. Movement of the target 48 while using a binder clip prevents the movement of the target relative to the tubular dispenser 42 during use.

Referring now to FIG. 7, a cross-section of the first portion of the first rod is illustrated with the pin 54. The pin 54 has cap 56 which prevents it from sliding through the pin receiver 52 (which is obstructed from view by the first portion 26 of the first rod 22). The flange 72 of end cap 44 holds the end cap 44 in place. The opening 74 within the end cap 44 is sized to rotatably receive the pin 54. A number of targets 48 are illustrated around the target dispenser 42.

Figure 8:
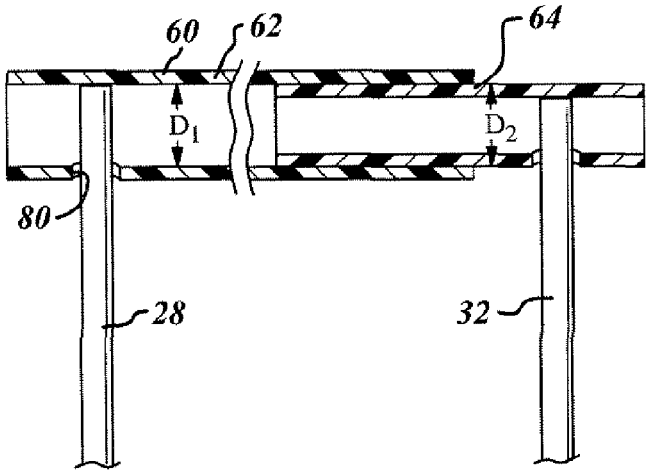
FIG. 8 is a cross-sectional view of the end of one of the rods coupled to the target receiver 60.

Referring now to FIG. 8, a cross-sectional view of the intersection of the second portion 28 of the first rod 22 and the target receiver 60 is illustrated. As is illustrated, the first portion 62 has an interior diameter D1 that is about the same size as the exterior diameter D2 of the second portion 64. The extendable target receiver 60 allows the target receiver 60 to be compact and fit within the target dispenser 42 during transportation. An opening 80 is provided in each end of the respective first portion 62 and the second portion 64. The opening 80 is sized to receive the second portion 28 of the first rod 22. The end of the first rod 22 may thus extend into the interior of the target receiver 60 without extending therethrough. This prevents the rotation of the first rod 60 and also positions the end of the second portion 28 a predetermined distance from the end of the second portion 32.

Figure 9:
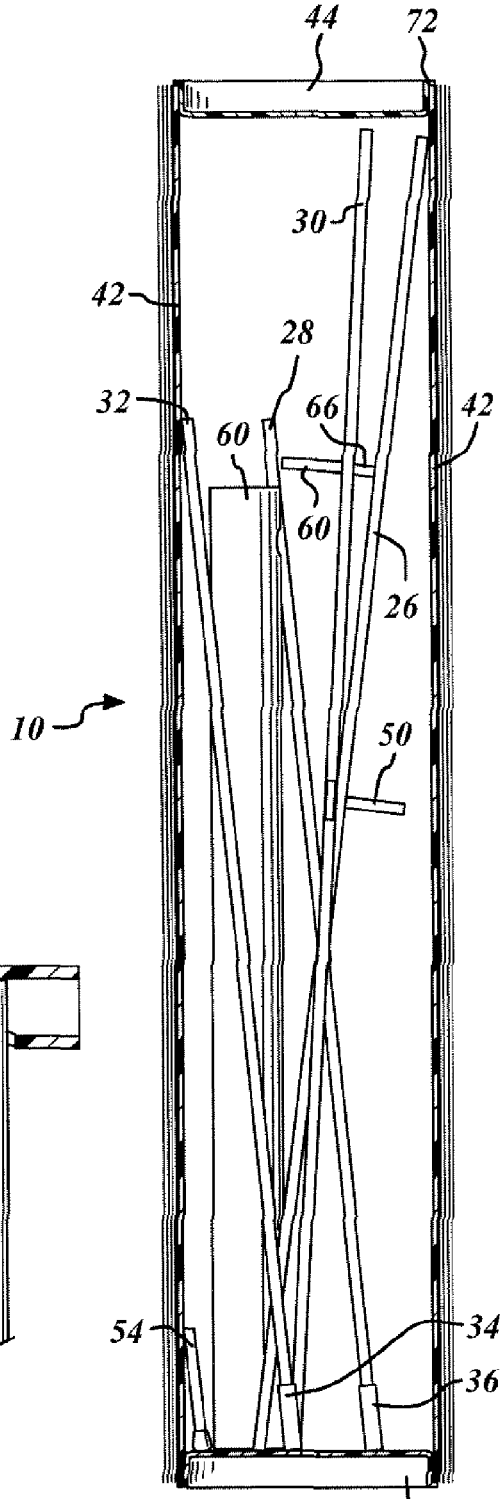
FIG. 9 is a cross-sectional view of the device in a disassembled mode.

Referring now to FIG. 9, the apparatus has a disassembled and an assembled configuration. FIG. 9 illustrates the disassembled and transportable target apparatus 10. This may be contrasted with the assembled configuration of FIG. 2. Because of the lengths of the first portion 26, second portion 28, the first portion 30, and the second portion 32 as well as the length of the target receiver 60, each of the components may fit within the interior of the target dispenser 42 for transportation. The pin 54 may also be stored with the target dispenser 42.

In operation, target apparatus 10 is easily assembled by inserting the first portion 26 and the second portion 28 into the ferrule 34. Second rod 24 is assembled by placing the first portion 30 and the second portion 32 into ferrule 36. The first rod 22 and the second rod 24 are secured to the ground by insertion using the foot peg 66. The target dispenser 42 is placed so that the first end cap 44 is disposed on the fixed pin 50 and the second end cap 46 is positioned to receive the pin 54 through the pin receiver 52. A target is then extended to the target receiver 60. Clips may be provided to secure the target to the target dispensers 42. Adhesive may be used to secure the target to itself or directly to the target receiver 60. Shots may then be fired at the target 48 so that the shot pattern may be characterized. If another shot is desired to be measured, another target may be dispensed. The target apparatus may be then disassembled and placed within the target dispenser 42.

While particular embodiments of the invention have been shown and described, numerous variations and alternate embodiments will occur to those skilled in the art. Accordingly, it is intended that the invention be limited only in terms of the appended claims.

What is claimed is:

1. A target apparatus having an assembled state and a disassembled state comprising: in the assembled state:

a first rod having a first portion and a second portion having a first length and a second length, respectively;

said first portion having a fixed pin for receiving a first end cap;

a first ferrule coupling said first portion and said second portion;

a second rod having a third portion and a fourth portion, a third length and a fourth length, respectively;

a pin;

said third portion having a pin receiver for receiving the pin;

a second ferrule coupling said third portion and said fourth portion;

a target;

a tubular target receiver having an extended length and a compressed length;

a tubular target dispenser coupled to said first fixed pin and pin receiver, said target coupled to said dispenser and sized to extend to said tubular target receiver, said dispenser having a fifth length greater than said first length, said second length, said third length, said fourth length and said compressed length, wherein in the disassembled state, said first portion, said second portion, said third portion and said fourth portion, said pin and said tubular target receiver received within said hollow interior of said dispenser and said end caps being received within said dispenser.

* * * * *